US007114211B2

(12) United States Patent
Elster

(10) Patent No.: US 7,114,211 B2
(45) Date of Patent: Oct. 3, 2006

(54) CLEANING BRUSH FOR SANITARY APPLIANCE

(76) Inventor: Zvi Elster, 19 HaZayic Street, Ramla 72511 (IL)

( * ) Notice: Subject to any disclaimer, the term of this patent is extended or adjusted under 35 U.S.C. 154(b) by 66 days.

(21) Appl. No.: 10/901,076

(22) Filed: Jul. 29, 2004

(65) Prior Publication Data

US 2005/0022324 A1 Feb. 3, 2005

(51) Int. Cl.
*A46B 13/04* (2006.01)

(52) U.S. Cl. ..... 15/24; 15/29

(58) Field of Classification Search ..... 15/24, 15/29

See application file for complete search history.

(56) References Cited

U.S. PATENT DOCUMENTS 2,671,926 A * 3/1954 Minerley ..... 15/387
3,065,477 A * 11/1962 McKechnie ..... 15/29
3,195,157 A * 7/1965 Thorne-Symmons ..... 15/40
3,638,264 A * 2/1972 Walton ..... 15/4
3,892,004 A * 7/1975 Downes ..... 15/102
3,943,591 A * 3/1976 Lanusse ..... 15/29
3,968,789 A * 7/1976 Simoncini ..... 601/95
4,189,801 A * 2/1980 Lanusse ..... 15/22.1
4,208,753 A * 6/1980 Lewis ..... 15/29
4,796,321 A * 1/1989 Lee ..... 15/29
5,680,666 A * 10/1997 Ra ..... 15/97.2
5,701,625 A * 12/1997 Siman ..... 15/21.1
5,881,418 A * 3/1999 Enoch ..... 15/101
5,960,503 A * 10/1999 Del Pozo Y Mattei ..... 15/29
6,062,229 A * 5/2000 Kandratavich et al. .... 132/73.6
6,292,971 B1 * 9/2001 Chaudray ..... 15/29

FOREIGN PATENT DOCUMENTS

GB 2318043 * 4/1998
NL 9100185 * 2/1991

* cited by examiner

*Primary Examiner*—Mark Spisich
(74) *Attorney, Agent, or Firm*—Dekel Patent Ltd.; David Klein

(57) ABSTRACT

A cleaning brush including a housing including a reservoir for storing therein cleaning fluid, the reservoir in fluid communication with a pump, a hollow spindle rotatably mounted in the housing, connected to and powered by a motor, the hollow spindle being in fluid communication with the pump, and a brush including bristles in fluid communication with the hollow spindle, wherein a fluid flowing through the hollow spindle flows directly to the bristles of the brush.

7 Claims, 4 Drawing Sheets

CLEANING BRUSH FOR SANITARY APPLIANCE

FIELD OF THE INVENTION

The present invention relates generally to cleaning brushes, and particularly to a motorized cleaning brush for cleaning sanitary appliances, such as but not limited to, a toilet bowl.

BACKGROUND OF THE INVENTION

People are accustomed to and expect cleanliness in homes, hotels, service stations and the like. A filthy washroom in a commercial establishment is both disgusting and unforgettable, particularly if it is in a restaurant. In the domestic area, homeowners are also concerned with maintaining a clean bathroom.

Unfortunately, due to the basic design of the toilet, it is difficult to keep it clean for any period of time. The area around the inside rim of the toilet bowl is virtually inaccessible, and invites the lodging and multiplication of waste bacteria and germs. Therefore, even a toilet that looks clean may not be truly sterile, as the bacteria clings to the underside of the rim. The more clean this troublesome area is, the longer the entire toilet bowl looks and stays clean.

Many devices have been made and proposed to help clean sanitary appliances, such as the toilet bowl. For example, U.S. Pat. No. 4,397,056 to Miller describes a power assisted device for cleaning toilet bowls, which includes an elongated stem portion having a brush at the distal end thereof, and a spray outlet port proximate to the brush. The brush is joined to a reciprocally rotating shaft extending through the stem to provide agitation to the brush. At the proximal end of the stem, a housing includes a pump connected between a liquid cleanser tank and tubing extending from the pump to the spray outlet. The housing includes rechargeable batteries to drive the pump and a motor assembly that drives the brush.

U.S. Pat. No. 5,423,102 to Madison describes a portable hand held cleaning device adapted to receive various cleaning implements, such as bristle brushes, abrasive wheels, chisels, and the like, into a tool engaging member. The tool engaging member is preferably operable by a rechargeable battery to selectively rotate and/or reciprocate at varying speeds. The rechargeable battery is included in a housing. The tool engaging member is preferably displaceable to improve the efficiency of the cleaning device in hard to reach areas. The housing may further include plumbing and a pump for delivering fluid from a cleansing fluid container to a discharge proximate the cleaning tool engaging member.

U.S. Pat. No. 5,649,334 to Henriquez et al. describes a dispensing scrubber apparatus that includes a pistol-shaped housing which has a hand-grip portion and a scrubber-holder portion. A primary fluid conveyance assembly includes, in sequence, an inlet end, a pre-valve conduit, a valve assembly, a post-valve conduit, and an outlet end. A flexible hose has one end connected to the inlet end of the primary fluid conveyance assembly and has another end that includes a faucet connector. Rechargeable batteries are housed within the housing and power a DC motor. A trigger-containing switch assembly is connected between the motor and the batteries. A drive shaft is connected to the motor, and a scrubber head is connected to the drive shaft. A spray nozzle is connected to the outlet end of the post-valve conduit. The drive shaft is hollow and forms a portion of the post-valve conduit of the primary fluid conveyance assembly. The fluid is sprayed near the brush.

SUMMARY OF THE INVENTION

The present invention seeks to provide an improved and novel motorized cleaning brush for cleaning sanitary appliances, such as but not limited to, a toilet bowl, as is described more in detail hereinbelow. Unlike the prior art, in the present invention, the cleaning fluid may be directed to the bristles of the brush for improved cleaning.

There is thus provided in accordance with an embodiment of the present invention a cleaning brush comprising a housing comprising a reservoir for storing therein cleaning fluid, the reservoir in fluid communication with a pump, a hollow spindle rotatably mounted in the housing, connected to and powered by a motor, the hollow spindle being in fluid communication with the pump, and a brush comprising bristles in fluid communication with the hollow spindle, wherein a fluid flowing through the hollow spindle flows directly to the bristles of the brush.

In accordance with an embodiment of the present invention, the hollow spindle comprises a one-way valve, wherein the one-way valve permits fluid to flow to the bristles of the brush only upon application of pressure to the brush.

Further in accordance with an embodiment of the present invention the reservoir comprises a cover and a sealing cap.

Still further in accordance with an embodiment of the present invention the motor is energized by a power source housed in the housing.

In accordance with an embodiment of the present invention the motor may be controlled by a switch configured like a trigger.

Further in accordance with an embodiment of the present invention the pump comprises a push button handle and a plunger that pumps fluid from the reservoir to a chamber in the housing, wherein the spindle is in fluid communication with the chamber. The switch and the push button handle may be positioned on opposite sides of a pistol grip handle of the housing.

BRIEF DESCRIPTION OF THE DRAWINGS

The present invention will be understood and appreciated more fully from the following detailed description, taken in conjunction with the drawings in which.

DETAILED DESCRIPTION OF A PREFERRED EMBODIMENT

Figure 1:
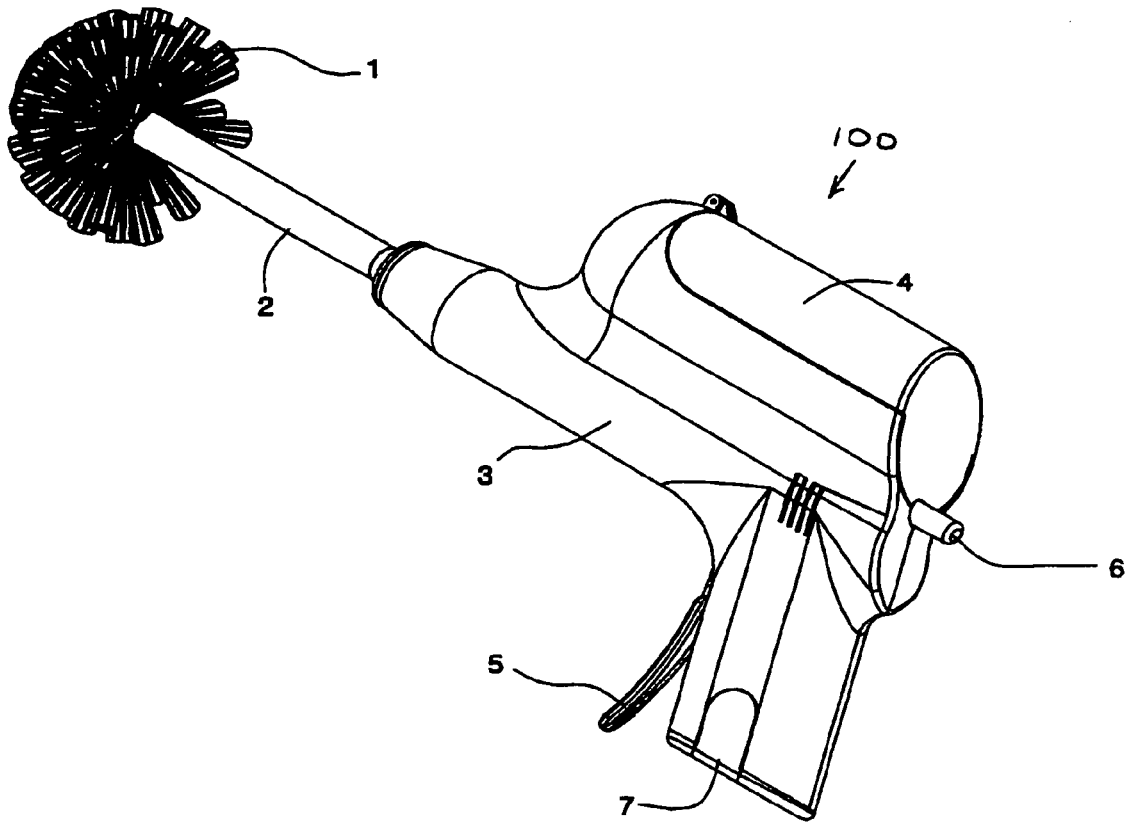
FIG. 1 is a simplified pictorial illustration of a cleaning brush, constructed and operative in accordance with an embodiment of the present invention.

Reference is now made to FIG. 1, which illustrates a cleaning brush 100, constructed and operative in accordance with an embodiment of the present invention.

The cleaning brush 100 may comprise a housing 3, which may have a pistol-like shape for easy handling. A reservoir 12 may be provided for storing therein cleaning fluid, such as but not limited to, water, toilet cleaning solvents, ammonia solution, borax solution, etc. Reservoir 12 may be accessed by lifting a cover 4 and removing a sealing cap 8, as seen in FIGS. 2 and 3.

A hollow spindle 2 may be rotatably mounted in housing 3, and may be connected to and powered by a motor 9. Motor 9 may be energized by a power source 7, such as a battery housed in the "pistol grip handle" of housing 3, and may be controlled by a switch 5, which may be configured like a trigger.

Figure 2:
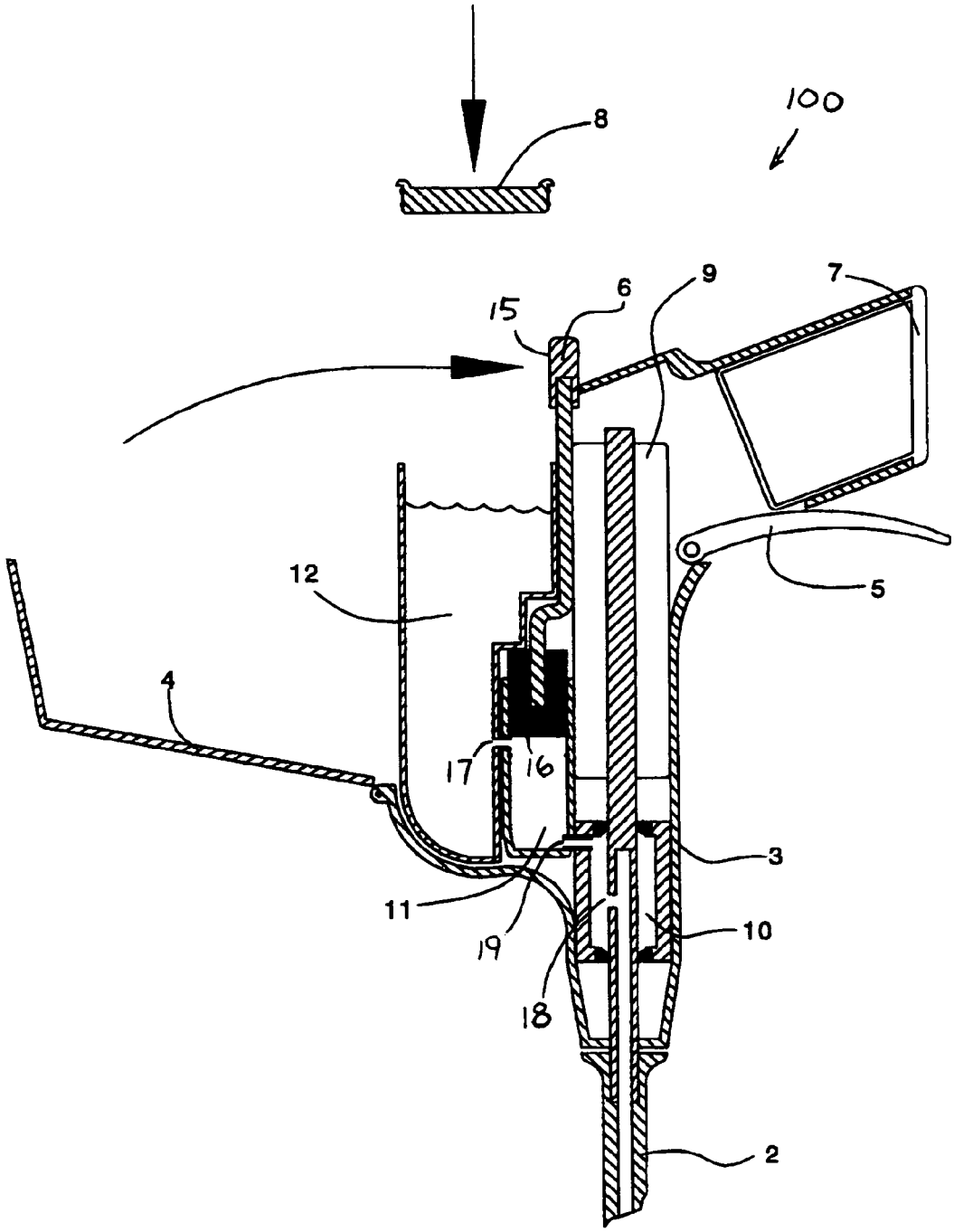
FIG. 2 is a simplified sectional illustration of the cleaning brush of FIG. 1, showing a reservoir for cleaning fluid.
Figure 3:
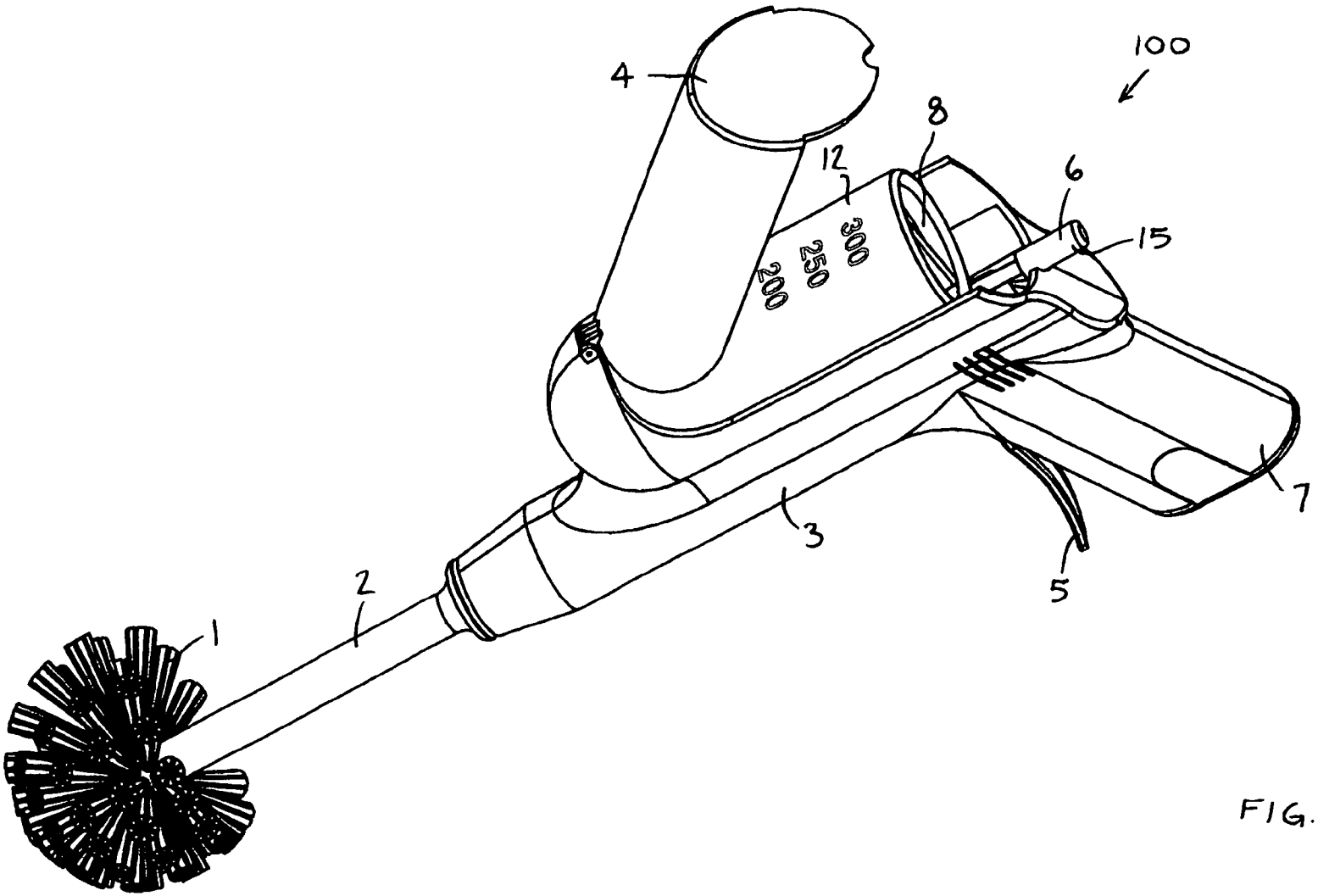
FIG. 3 is a simplified pictorial illustration of the cleaning brush of FIG. 1.

Reference is now particularly made to FIG. 2. Reservoir 12 may be in fluid communication with a pump 6, such as via a fluid port 17. Pump 6 may comprise a push button handle 15, accessible at the rear portion of housing 3. Pump 6 may comprise a plunger 16 that pumps fluid from reservoir 12 to a chamber 11, which flows through an orifice 19 to another chamber 10. Spindle 2 may be formed with an aperture 18 through which the fluid may enter from chamber 10. The switch 5 and push button handle 15 may be positioned on opposite sides of the pistol grip handle of housing 3.

The fluid then flows through hollow spindle 2 to the bristles of a brush 1. The fluid is thus dispensed directly onto the bristles, unlike the prior art which dispenses the fluid near, but not on the bristles.

Figure 4:
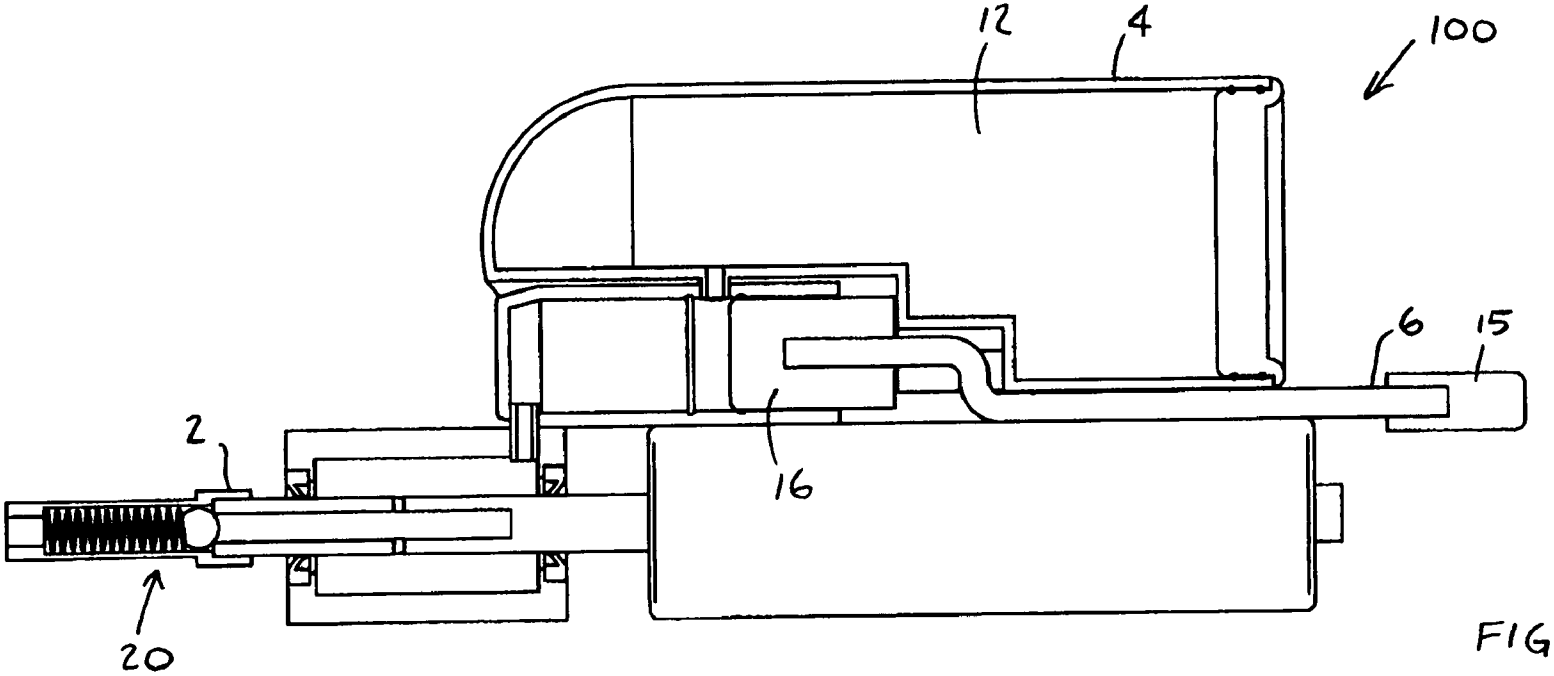
FIG. 4 is a simplified sectional illustration of the cleaning brush of FIG. 1, showing a possible valve arrangement in accordance with another embodiment of the present invention, some of the parts shown in FIGS. 1–3 being omitted in FIG. 4 for the sake of simplicity.

As seen in FIG. 4, the hollow spindle 2 may be provided with a one-way valve 20, which may comprise a ball and spring, although other kinds of valves may also be used in the invention. Fluid may flow through hollow spindle 2 to the bristles of brush 1 only upon application of pressure to brush 1, such as when pressing the brush 1 against the sides of a toilet bowl (not shown). In accordance with another embodiment, a pressure-type switch may be provided wherein pressing the brush 1 against an object (e.g., the sides of the toilet bowl) activates motor 9.

It will be appreciated by persons skilled in the art that the present invention is not limited by what has been particularly shown and described hereinabove. Rather the scope of the present invention includes both combinations and subcombinations of the features described hereinabove as well as modifications and variations thereof which would occur to a person of skill in the art upon reading the foregoing description and which are not in the prior art.

What is claimed is:

1. A cleaning brush comprising:

a housing comprising a reservoir for storing therein cleaning fluid, said reservoir in fluid communication with a pump;

a hollow spindle rotatably mounted in said housing, connected to and powered by a motor, said hollow spindle being in fluid communication with said pump; and a brush comprising bristles in fluid communication with said hollow spindle, wherein a fluid flowing through said hollow spindle flows directly to said bristles of said brush;

wherein said pump comprises a push button handle and a plunger that pumps fluid from said reservoir to a chamber in said housing, wherein said spindle is in fluid communication with said chamber, and wherein said motor is controlled by a switch configured like a trigger, and said switch and said push button handle are positioned on opposite sides of a pistol grip handle of said housing.

2. The cleaning brush according to claim 1, wherein said hollow spindle comprises a one-way valve, wherein said one-way valve permits fluid to flow to said bristles of said brush only upon application of pressure to said brush.

3. The cleaning brush according to claim 1, wherein said reservoir comprises a cover and a sealing cap.

4. The cleaning brush according to claim 3,wherein said reservoir comprises fluid level markings and said cover of said reservoir is hinged to said housing, and when said cover is in an open position, said fluid level markings are visible.

5. The cleaning brush according to claim 1, wherein said motor is energized by a power source housed in said housing.

6. A cleaning brush comprising:

a housing comprising a reservoir for storing therein cleaning fluid, said reservoir in fluid communication with a pump;

a hollow spindle rotatably mounted in said housing, connected to and powered by a motor, said hollow spindle being in fluid communication with said pump; and a brush comprising bristles in fluid communication with said hollow spindle, wherein a fluid flowing through said hollow spindle flows directly to said bristles of said brush;

wherein said hollow spindle comprises a one-way valve, wherein said one-way valve permits fluid to flow to said bristles of said brush only upon application of pressure to said brush;

wherein said reservoir comprises a cover and a sealing cap;

wherein said motor is energized by a power source housed in said housing and is controlled by a switch configured like a trigger;

wherein said pump comprises a push button handle and a plunger that pumps fluid from said reservoir to a chamber in said housing, wherein said spindle is in fluid communication with said chamber; and wherein said switch and said push button handle are positioned on opposite sides of a pistol grip handle of said housing.

7. The cleaning brush according to claim 6, wherein said reservoir comprises fluid level markings and said cover of said reservoir is hinged to said housing, and when said cover is in an open position, said fluid level markings are visible.

* * * * *